United States Patent [19]

Seeland

[11] Patent Number: 4,735,219

[45] Date of Patent: Apr. 5, 1988

[54] ELECTRONIC APPLIANCE CONTROL WITH USAGE RESPONSIVE DEFAULT CYCLE

[75] Inventor: Rodney F. Seeland, Lincoln Township, Berrien County, Mich.

[73] Assignee: Whirlpool Corporation, Benton Harbor, Mich.

[21] Appl. No.: 848,561

[22] Filed: Apr. 7, 1986

[51] Int. Cl.[4] ..... B08B 3/02

[52] U.S. Cl. ..... 134/56 R; 134/18; 134/25.2; 134/57 R

[58] Field of Search ..... 134/56 R, 56 D, 57 R, 134/57 D, 58 R, 58 D, 18, 25.1, 25.2; 68/12 R

[56] References Cited

U.S. PATENT DOCUMENTS 4,063,221 12/1977 Watson et al. .
4,176,394 11/1979 Kaminski et al. .
4,225,639 3/1981 Kawabata et al. .
4,231,106 10/1981 Heap et al. .
4,404,625 9/1903 Saito et al. ..... 68/12 R
4,461,959 7/1984 Pellerin ..... 68/12 R

OTHER PUBLICATIONS

General Electric GSD2800N Owner's Manual, p. 4.

*Primary Examiner*—Harvey C. Hornsby
*Assistant Examiner*—Frankie L. Stinson
*Attorney, Agent, or Firm*—Lowe, Price, Leblanc, Becker & Shur

[57] ABSTRACT

In an appliance operable in any of a number of different cycles, selectable by a user, a default control selects a default cycle of operation of the appliance in an absence of a current user selection. The control counts the number of times each cycle is executed by the appliance and compares the relative magnitudes of the cycle counts to identify the cycle that currently is the "favorite". In the preferred embodiment, default cycles and options in a dishwasher are selected based upon prior patterns of usage.

24 Claims, 5 Drawing Sheets

| | | | |
|---|---|---|---|
| CYCLE A COUNTER | CYCLE B COUNTER | – | CYCLE N COUNTER |
| OPTION TYPE A | OPTION TYPE A | OPTION TYPE A | OPTION TYPE A |
| OPTION TYPE B | OPTION TYPE B | OPTION TYPE B | OPTION TYPE B |
| – | – | – | – |
| OPTION TYPE N | OPTION TYPE N | OPTION TYPE N | OPTION TYPE N |

ELECTRONIC APPLIANCE CONTROL WITH USAGE RESPONSIVE DEFAULT CYCLE

TECHNICAL FIELD

This invention relates generally to default cycle selection in user controlled appliances, and, more particularly, toward selection of default cycles in appliances in accordance with prior patterns of usage.

BACKGROUND ART

In domestic appliances, operation to carry out any of a number of different operating cycles selectable by the user is controlled mechanically via electromechanical timers or electronically via electronic microprocessor based on sequential logic controls. A dishwasher, for example, is pre-programmed to operate in any of a number of different automatic cycles, and within each cycle, to operate in any of a preselected group of "options". Each automatic cycle comprises a sequence of washing, rinsing, and drying operations, such as a pre-rinse cycle, a plurality of wash cycles, at least one post-rinse cycle and a dry cycle, together comprising a NORMAL dishwasher cycle. Other automatic cycles contain greater or fewer separate operations, having durations controlled by the timer or solid state clock.

Options enable the user to tailor each automatic cycle to the user's requirements. For example, an AIR DRY option carried out during a NORMAL automatic cycle deenergizes the heater during the dry cycle to enable dishes to air dry and thereby conserve energy. Of course, only those options which are compatible with the particular automatic cycle being executed by the appliance can be selected.

The dishwasher or other appliance is provided with a control panel having an array of switches and buttons that enable the user to select manually the particular cycles and options desired, depending upon the particular load being washed or otherwise processed. In the event that no selections are made by the user, the appliance will operate in a "default" cycle which, in accordance with the prior art and in the case of a dishwasher, consists of the cycle and option selected by the user when the dishwasher was last operated. The default operation of the dishwasher or other appliance may, however, have no relationship to the types of load that the user tends to wash or otherwise process and no relationship to the user's habits or inclinations.

Accordingly, one object of the invention is to provide an appliance control that selects, as a default cycle, a cycle that is automatically determined as a result of patterns of prior usage of the appliance.

Another object is to provide a method of and apparatus for controlling an appliance to operate, in the absence of a current user selection, in a default cycle determined by the cycle selections most commonly previously made by the user.

Another object is to provide, in a dishwasher control, default cycle and option selections that are based upon the favorite selections made previously by the user.

An additional object is to provide a method of and system for establishing and displaying to the user a default cycle in accordance with previously established patterns of usage of the appliance.

DISCLOSURE OF INVENTION

A default control for selecting a default cycle of operation of an appliance, in accordance with a broad aspect of the invention, comprises means for monitoring user selected cycles of operation of the appliance, and means for counting the number of times each cycle of operation is selected by the user and, in response, selecting one of the cycles counted as the default cycle.

In accordance with another aspect of the invention, the default cycle selected is the one having the maximum count. In the event that plural cycles have the maximum count, a tie breaking means selects one of the cycles as the default cycle in accordance with a predetermined hierarchy that may be based upon energy utilization, or selects as the default cycle the earliest entered of the plural cycles.

In accordance with a further aspect of the invention, the count associated with each cycle of operation is incremented as that cycle is executed by the appliance. If the maximum cycle count is at least as great as a threshold count, however, the counts of all cycles, other than the cycle executed, are decremented. This limits the maximum count that must be handled by the default circuit and furthermore controls the sensitivity of the circuit to changing patterns of appliance usage.

In accordance with a preferred embodiment of the invention, the threshold count is controlled in proportion to the rate of change of cycles selected by the user. Thereby, the default cycle is more easily changed by a conservative user than by a more adventurous one.

Thus, the invention enables the appliance to respond to the preferences of the user established over time to select the default cycle within which the appliance operates if no cycle is selected by the user at the time appliance operation is initiated. The default cycle thus can be said to be a "favorite" cycle of the user that is established over time in accordance with usage.

In accordance with a preferred embodiment, default cycle selection is made in a dishwasher wherein user selections of dishwasher cycles and options are monitored, counted and further processed to determine default operation. Default operation is overridden by manual selection of cycles and options at the time dishwasher operation is initiated.

Accordingly, a further object of the invention is to provide a method of and apparatus for determining, in accordance with patterns of previous usage, default cycles and options for dishwasher control.

Still other objects and advantages of the present invention will become readily apparent to those skilled in this art from the following detailed description, wherein I have shown and described only the preferred embodiment of the invention, simply by way of illustration of the best cycle contemplated by me of carrying out my invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

Other features and advantages of the invention will be apparent from the following description taken in connection with the accompanying drawing, wherein.

BEST MODE FOR PRACTICING THE INVENTION

Figures 1, 2:
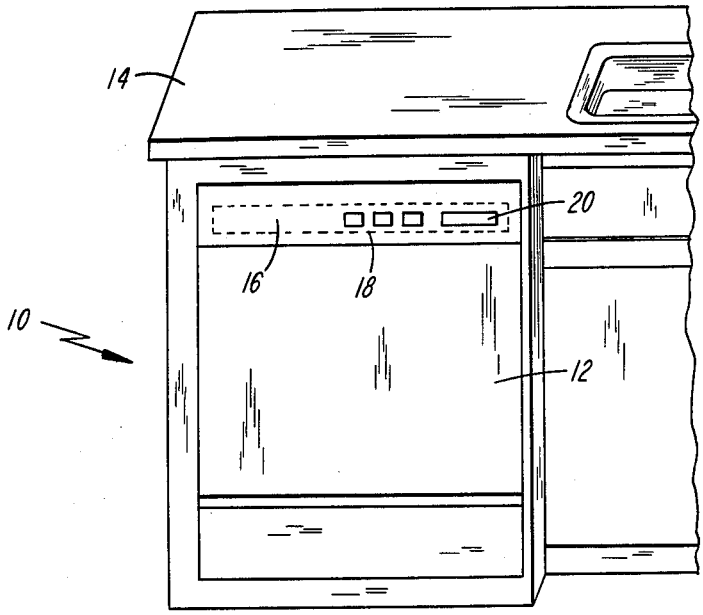
FIG. 1 is a perspective view of a front loading dishwasher having a "favorite cycle" default cycle of operation provided in accordance with the principles of the invention.
FIG. 2 is a matrix of dishwasher cycles and options available within each cycle.

In the exemplary embodiment of the invention as shown in the drawing, a dishwasher generally designated 10 in FIG. 1 comprises a cabinet 12 housing a washing chamber retained beneath a countertop 14. The dishwasher 10 has a control console 16 provided with a number of manual switches, such as 18, to enable a user to select dishwasher cycles and options, and a display 20 to display to the user information on the current status of the dishwasher.

Within the dishwasher 10, although not shown in FIG. 1, are racks upon which dishes and untensils are placed, at least one spray arm for impinging water onto the dishes and untensils and detergent dispensing cups. A motor driven pump within the dishwasher, together with suitable valves, a heater and necessary sensors, cooperate to carry out a number of different automatic cycles preprogrammed in a timer control which, in the preferred embodiment, comprises a microcomputer.

Figure 3:
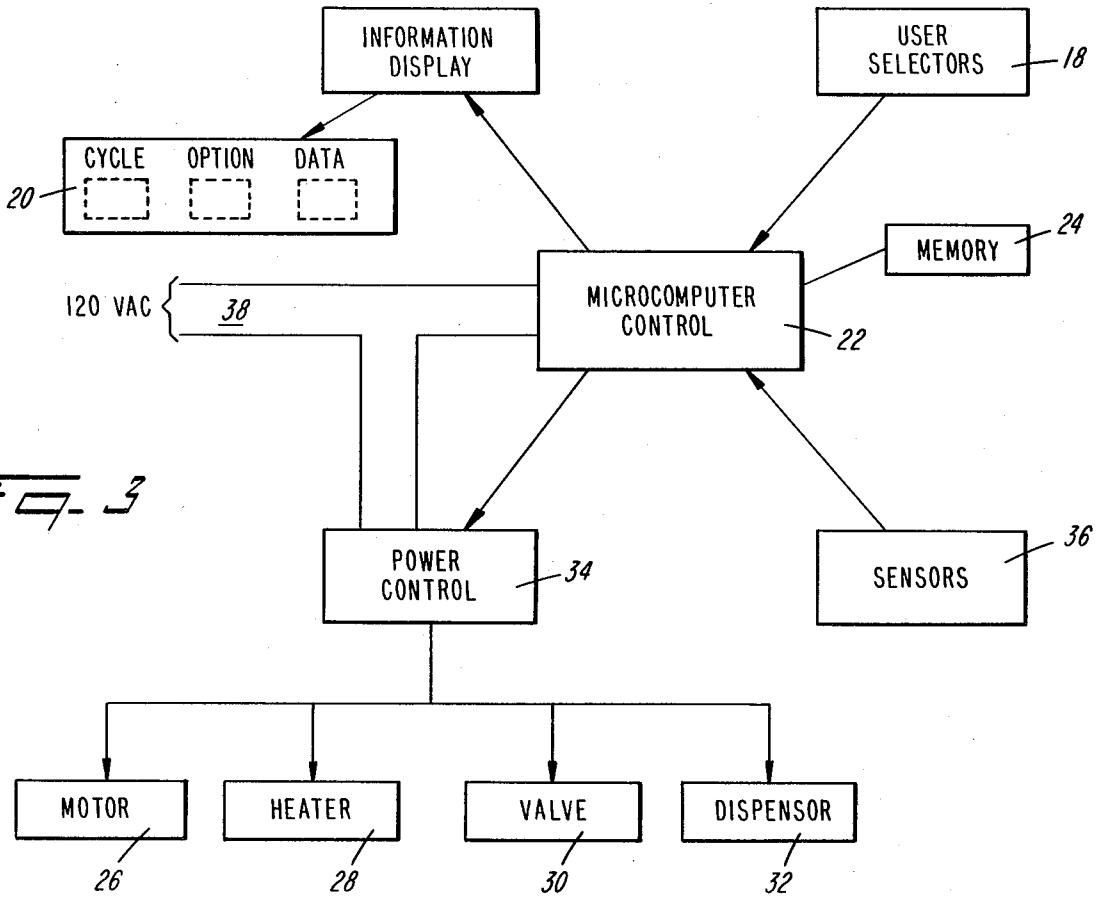
FIG. 3 is a simplified block diagram of a dishwasher control system employed by carrying out the invention.

Thus, referring to FIG. 3, a microcomputer 22 located preferably within dishwasher 10 but locatable elsewhere as well, receives as inputs user selections entered manually by the user at switches 18 on the console 16. The information obtained by the microcomputer 22 from the console 18 is typically in the form of digital signals developed as a function of the status of the switches involved. The switches, in combination, identify any one of a number of different automatic cycles within which the dishwasher is programmed to operate. This is represented by the upper row of FIG. 2 for an arbitrary case wherein, in practice, automatic cycles such as POTS & PANS, HEAVY WASH, NORMAL WASH, LOW ENERGY WASH, and RINSE/HOLD are typical. Operable within each automatic cycle, and selectable by the user at 18, is an array of options, shown in the columns of FIG. 2. Examples of options which in practice are available in conventional dishwashers are AIR DRY and HIGH TEMPERATURE WASH.

It is desirable to provide only particular options, and not others, within each automatic cycle. For example, the AIR DRY option is in practice usable in the POTS & PANS, HEAVY WASH, and NORMAL WASH automatic cycles but not in the RINSE/HOLD automatic cycles. On the other hand, the HIGH TEMPERATURE WASH option may be preprogrammed part of the POTS & PANS cycle, a user selectable option for the HEAVY WASH, NORMAL WASH, and LOW ENERGY WASH cycles, and not selectable or usable for the RINSE/HOLD cycle. All the automatic cycles and their associated options are programmed in a memory 24 addressable by the microcomputer 22.

The particular cycle and option selected by the user as well as other data are displayed to the user by display unit 20, which may comprise a light emitting diode (LED) display controlled by digital signals applied to it by the microcomputer 22.

Pump motor 26, heater 28, valves 30 and dispensers 32 are all controlled by the microcomputer 22 through a power control 34 which comprises a set of electromechanical relays or other power controlling devices, such as silicon controlled rectifiers (SCRs) or Triacs. The microcomputer 22 in turn responds to sensors 36, such as conventional water level, temperature or turbity sensors, to control the dishwasher through its successive cycles. Timing for the microcomputer 22 is established by a reference (not shown) which may be synchronized to the zero crossover points of voltage on the power lines 38 or to some other timing source.

The microcomputer 22 may be of any conventional type, formed on an integrated circuit and controlled by firmware stored in memory 24 to carry out pre-established dishwasher functions. Alternatively, standard dishwasher functions may be controlled by a conventional electromechanical timer. In either case, default control in accordance with the invention is provided by the microcomputer 22, programmed to monitor cycles and options selected by the user, count the number of times each cycle and the number of times each option are selected and, in response, establish as a default mode of operation of the dishwasher the cycle and options determined through prior dishwasher usage to be the "favorites" of the user. Thereafter, in the absence of a user selection at the control console 18, the dishwasher is controlled to operate with the "favorite" cycle and options of the user rather than operate with the cycle and options at which the dishwasher was previously set.

Assume that a user prefers a NORMAL cycle and accordingly typically selects at the dishwasher console the NORMAL cycle, together with preferred options, for execution by the dishwasher. Assume further that thereafter, on one occasion, the user selects a RINSE/-HOLD cycle. Whereas in the prior art, the RINSE/-HOLD cycle, being the last cycle selected, is now designated as the default cycle, the invention herein recognizes the NORMAL cycle as being the "favorite" cycle of the user and establishes the NORMAL cycle as the default cycle. In more complex usage patterns wherein a user over time selects among various different cycles and options, the invention counts the number of times each cycle and options are selected, makes a determination of which cycle and options are deemed the "favorites" of the user and selects those as the default mode of the appliance.

Figure 4A:
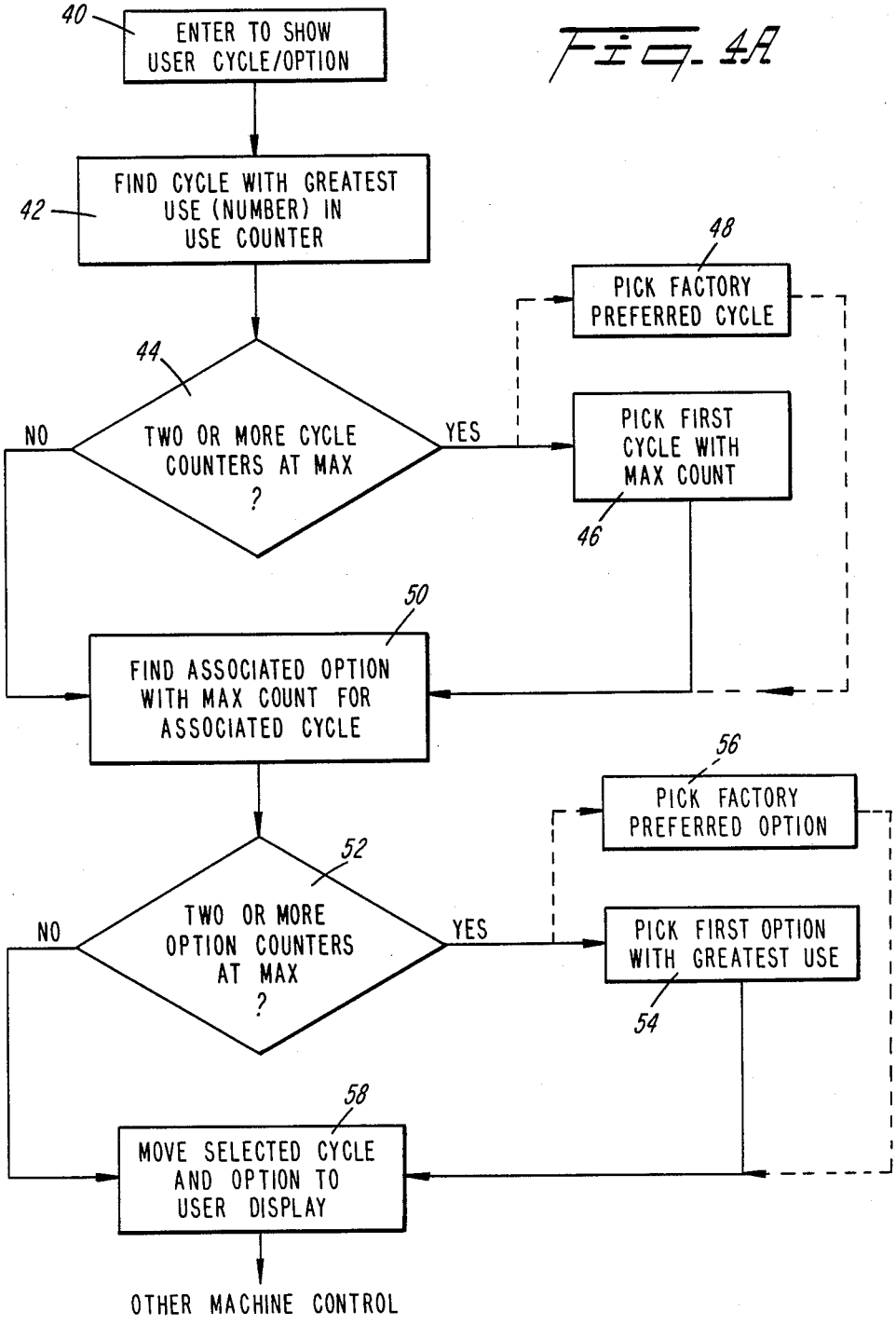
FIGS. 4A–4C are a block diagram of firmware for selecting the default operation of the dishwasher.

Firmware stored in memory 24 (FIG. 3) for controlling the microcomputer 22 to display at 20 the current default cycle and default options is set forth in FIG. 4A. Assume that cycle and option counters provided by partitioning within the memory 24, or provided elsewhere, are loaded with current cycle and option counts. In response to a user request to display the current default cycle and default options at Step 40, the microcomputer 22 polls the cycle counters, each having stored within it the current count of its designated cycle, to determine which count among all the cycle counts is the greatest (Step 42). If two or more counters are at the maximum count, indicating a "tie" (Step 44), the tie is broken by selecting as the default cycle the first maximum count cycle, i.e., the earlier or earliest of the maximum count cycles previously executed by the appliance (Step 46). Alternatively, a factory preferred cycle (Step 48) which may be an energy efficient cycle, or one of a hierarchy of preferred cycles, may be selected as the default cycle.

Associated with each cycle are a particular group of compatible options. Once a default cycle is established in Steps 44, 46 and 48, the option or group of options most commonly selected by the user are identified in Step 50 by polling the option counters to determine which one has a maximum count. If two or more option counters have the maximum count (Step 52), tie breaking is again carried out either by selecting the earlier or earliest executed maximum count option (Step 54) or by selecting a factory preferred option or one among a hierarchy of preferred options (Step 56). The cycle and options thus selected as the default mode of the dishwasher are transferred to display 20 (Step 58).

In response to a user command, the microcomputer 22 will now operate the dishwasher 10 in accordance with a current user selection or, in the absence of a user selection, in accordance with the default cycle and options previously established. The cycle and option counters now are updated to account for the cycle and options currently being executed by the dishwasher.

Figure 4B:
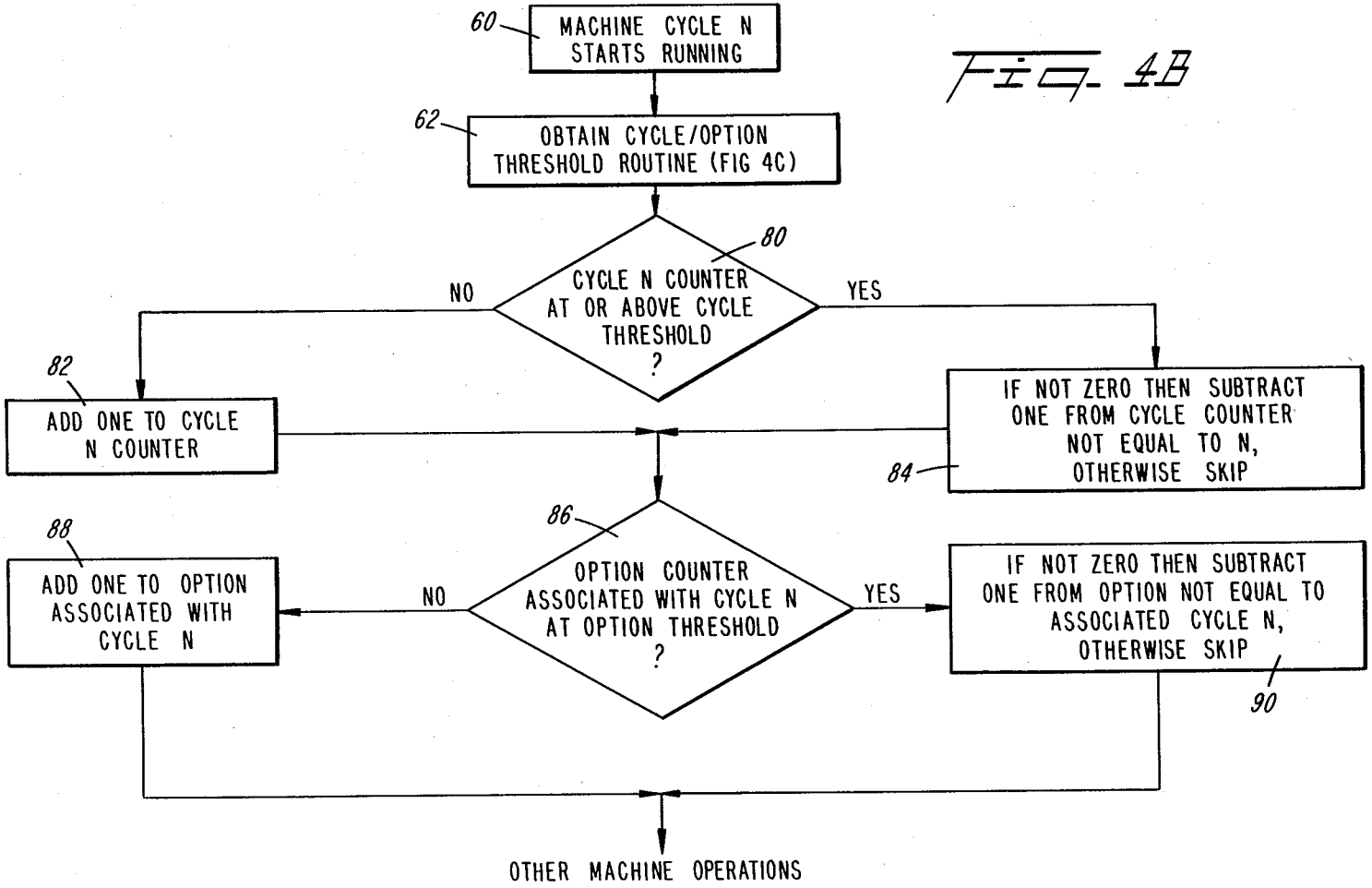

In FIG. 4B, the dishwasher is initially presumed to be operating in accordance with the user selected or default cycle and options (Step 60). Cycle and option thresholds, which establish the "sensitivity", or the tendency of the default mode of the dishwasher to be changed in response to changes in dishwasher usage, are obtained in Step 62. Thereby, a low threshold may be established for a conservative user who tends over time to use the same cycles and options, so that a change in the default mode of the appliance is effected in response to a relatively small change in the pattern of usage of the appliance. On the other hand, a higher threshold may be established for a user who, over time, tends to "experiment" with different cycles and options. The manner by which the sensitivity of the default control is established by the threshold count shall be discussed below. Attention is now given, however, to the means by which the threshold count is determined.

Figure 4C:
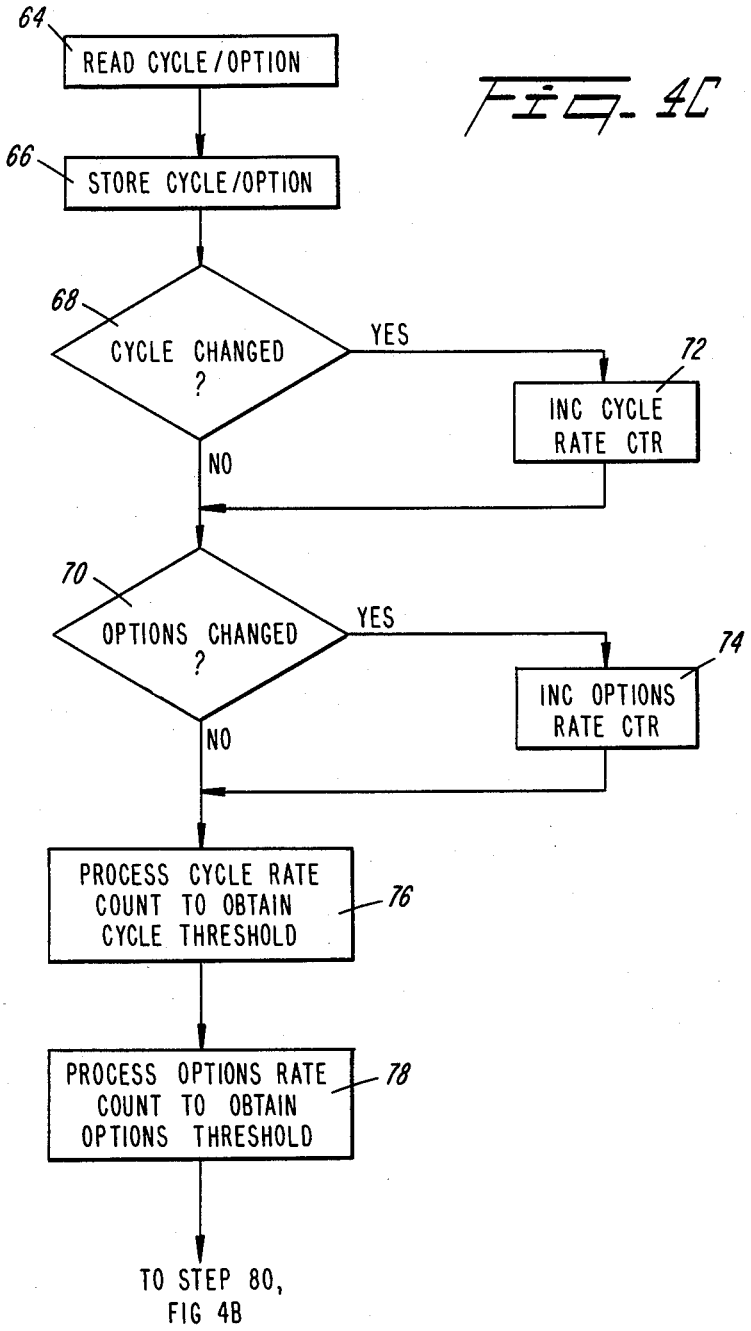

In accordance with the preferred embodiment of the invention, the cycle and options thresholds are predetermined and fixed in Step 62, which is actually a subroutine, described in FIG. 4C. The cycle and options threshold counts may, of course, be different or may be common. Typical threshold counts are three for each.

In accordance with the subroutine set forth in FIG. 4C, however, the cycle and options thresholds are determined by the rate of change of cycles and options selected by the user, whereby default sensitivity becomes "tailored" to the personality of the user. Each time the dishwasher 10 is operated through an automatic cycle, the current cycle and options, either selected by the user or default selected, are read (Step 64) and stored (Step 66) in memory 24. The currently stored cycle and options are compared with the previously stored cycle and options (Steps 68 and 70) and if either the cycle or the associated options has changed, a corresponding rate counter provided either in memory 24 or elsewhere in microcomputer 22 is incremented (Steps 72, 74). The cycle and options rate counts are now processed either algorithmically or by table lookup to obtain corresponding cycle and options thresholds (Steps 76, 78) to be applied to establish the upcoming default mode of the dishwasher.

For example, although not shown, a table stored in memory 24 may be formulated to associate particular cycle and option thresholds with particular cycle and options rate counts. The thresholds may be so related to the counts to enable the default mode to be changed readily in response to cycle and option changes by a conservative user but to tend to ignore small changes in cycles and options selected by a user who frequently changes cycles or options. Thresholds and rates preferably are proportional to each other, whereby a low rate of change of mode selection by a conservative user translates into a low cycle count threshold that is relatively sensitive to changes in appliance usage.

The routine of FIG. 4C continues to Step 80 in FIG. 4B, wherein it is determined whether the cycle counter is at the cycle threshold count. If the count of the current cycle is not at the threshold count, the cycle counter is incremented (Step 82). If the cycle count is at the threshold count, on the other hand, the counters associated with all the cycles other than the cycle executed by the appliance are decremented to, but not below, zero (Step 84). This process retains the relative relationship among the counts stored in the cycle counters but limits the absolute count of any counter to the threshold count, to prevent counter overflow.

Similarly, the option counter associated with the cycle being run is read to determine whether the option count is at the option threshold count (Step 86). If so, the content of the option counter associated with the cycle being run is incremented (Step 88); otherwise, the contents of all the option counters other than the option executed by the appliance are decremented to, but not below, zero (Step 90).

Selection of a "favorite" cycle and its associated "favorite" options, in accordance with the flow chart of FIGS. 4A–4C is now described with reference to Table 1 wherein the current default cycle, current user selected cycle and counters for three different exemplary cycles, NORMAL, POTS & PANS, and RINSE/-HOLD, are shown during nineteen successive cycles (a)–(s) of the dishwasher. It is assumed that the cycle threshold is preset and fixed at 3, whereby it is unnecessary to execute the routine 64 detailed in FIG. 4C. For simplicity, option default selection is ignored.

Assume that the default cycle is initially the NORMAL cycle prior to execution of automatic cycle (a). The default cycle may, for example, be preset by the factory so that NORMAL is presented when power is first applied to the dishwasher. Assume further that no cycle selection is made by the user, whereby the NORMAL automatic cycle is carried out by the dishwasher during (a). Because none of the three counters is at the threshold count of 3, the NORMAL cycle counter is incremented (in accordance with Steps 80 and 82 in FIG. 4B).

To initiate automatic cycle (b), the user has selected the RINSE/HOLD cycle, whereby the dishwasher executes RINSE/HOLD. The NORMAL cycle is retained as a default cycle, and would have been executed by the dishwasher in the absence of a user selection. The RINSE/HOLD cycle counter is now incremented, establishing a "tie" between the counts of the NORMAL and RINSE/HOLD counters. With reference to FIG. 4A, the firmware in memory 24 recognizes a "tie" during Step 44 and in accordance with Step 46 selects the earlier of the two cycles (NORMAL) as the default cycle.

Assume now that RINSE/HOLD is selected by the user as automatic cycle (c). With the NORMAL cycle retained as the default cycle, the dishwasher executes RINSE/HOLD, and increments the RINSE/HOLD counter. Because the RINSE/HOLD cycle count now exceeds the NORMAL cycle count, the RINSE/-HOLD cycle replaces the NORMAL cycle in automatic cycle (d) as the default cycle.

Because the user has not selected a cycle during execution of (d), the dishwasher defaults to the RINSE/-HOLD cycle and increments the RINSE/HOLD counter which now has attained the threshold count (3). The user selects the default cycle during automatic cycles (e) and (f) whereby the dishwasher executes the RINSE/HOLD default cycle. The RINSE/HOLD cycle counter is not incremented, however, because it is at the threshold count (see Steps 80 and 84 in FIG. 4B). Because the NORMAL and POTS & PANS cycle counters are at a 0 count, those counters are not decremented. Accordingly, the counts of all three counters remain constant until the POTS & PANS cycle is selected by the user during automatic cycle (g). With the RINSE/HOLD cycle remaining extant as the default cycle, the dishwasher executes a POTS & PANS cycle and increments the POTS & PANS cycle counter. This process is repeated during automatic cycle (h) selected as a POTS & PANS cycle by the user.

During automatic cycle (i), however, the user again selects the default cycle, causing the RINSE/HOLD default cycle to be executed. Since the RINSE/HOLD cycle counter is at the threshold count, and the POTS & PANS cycle counter is at a non-zero count, the POTS & PANS cycle counter is decremented as shown. It should be appreciated the difference between the counts in the POTS & PANS and RINSE/HOLD counters is 2, whereas the maximum count of any counter is limited to the threshold count of 3. This is the same difference that would have occurred had the count in the POTS & PANS cycle counter and RINSE/HOLD cycle counter both been incremented.

The operation of the cycle counters and selection of the default cycle during automatic cycles (j)–(s) should now be apparent by inspection.

The above description illustrates how the sensitivity of the default circuit established by microcomputer 22 and firmware in memory 24 is controlled by the threshold count which limits the maximum difference that can exist between any mode counts. Thus, in this example, with a threshold count pre-established at 3, any cycle that is selected by the user at least three times in succession will become selected as the default cycle. A threshold count that is greater, on the other hand, will inhibit any default cycle change unless a greater number of the same cycle compared to other cycles is selected by the user.

It is to be pointed out that the default cycle is changed to the cycle having the greatest count, in accordance with the preferred embodiment. It is to be recognized, however, that other relationships among counts could be predetermined to select the current default cycle. Furthermore, default cycle selection can be made based upon a requirement that the maximum cycle count be greater by a predetermined number that the next highest count to provide a "difference threshold". Thereby, a relatively strong pattern of usage in favor of a change in the default cycle is required before a change in the default cycle is made.

Although not shown in Table I, the default option presented to the user is determined by Steps 86, 88 and 90 in a manner that is completely analoguous to the operation described above in association with Table I.

There accordingly has been provided by this invention a method of and system for controlling a dishwasher or other appliance to operate in a user selected cycle or, in the absence of a user selected cycle, in a default cycle. The default cycle is established by patterns of use of the appliance, whereby the appliance in the absence of a current user selection operates in the "favorite" cycle of the user. Different criteria may be established for selecting the default cycle.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

TABLE I

| DEFAULT CYCLE PRESENTED | CYCLE SELECTED BY USER | NORMAL CYCLE COUNTER | POTS & PANS CYCLE COUNTER | RINSE/HOLD CYCLE COUNTER |
|---|---|---|---|---|
| (a) NORMAL | DEFAULT | 1 | 0 | 0 |
| (b) NORMAL | RINSE/HOLD | 1 | 0 | 1 |
| (c) NORMAL | RINSE/HOLD | 1 | 0 | 2 |
| (d) RINSE/HOLD | DEFAULT | 1 | 0 | 3 |
| (e) RINSE/HOLD | DEFAULT | 0 | 0 | 3 |
| (f) RINSE/HOLD | DEFAULT | 0 | 0 | 3 |
| (g) RINSE/HOLD | POTS & PANS | 0 | 1 | 3 |
| (h) RINSE/HOLD | POTS & PANS | 0 | 2 | 3 |
| (i) RINSE/HOLD | DEFAULT | 0 | 1 | 3 |
| (j) RINSE/HOLD | NORMAL | 1 | 1 | 3 |
| (k) RINSE/HOLD | NORMAL | 2 | 1 | 3 |
| (l) RINSE/HOLD | NORMAL | 3 | 1 | 3 |
| (m) NORMAL | DEFAULT | 3 | 0 | 2 |
| (n) NORMAL | DEFAULT | 3 | 0 | 1 |
| (o) NORMAL | DEFAULT | 3 | 0 | 0 |
| (p) NORMAL | DEFAULT | 3 | 0 | 0 |
| (q) NORMAL | RINSE/HOLD | 3 | 0 | 1 |
| (r) NORMAL | RINSE/HOLD | 3 | 0 | 2 |
| (s) NORMAL | DEFAULT | 3 | 0 | 1 |

I claim:

1. In an appliance having user selectable cycles of operation, input means for receiving cycle selections entered by the user and means responsive to said input means for controlling said appliance to operate in user selected cycles, a default control for selecting a default cycle of operation of the appliance in an absence of a user selected cycle at said input means, comprising:

means for monitoring the cycles of operation executed by said appliance;

means for counting the number of times each cycle of operation is executed by the appliance; and, in response, selecting one of said cycles counted as the default cycle.

2. The control of claim 1, including memory means for storing cycle counts obtained by said counting means, comparison means for identifying which one of said cycle counts is maximum, and wherein said default cycle selecting means includes means for selecting the cycle having the maximum cycle count as the default cycle.

3. The control of claim 2, wherein said default cycle selecting means includes means for detecting plural cycles having the same maximum count and tie breaking means for selecting a particular one of said cycles as the default cycle.

4. The control of claim 3, wherein said particular one of said cycles is a predetermined energy efficient cycle.

5. The control of claim 3 wherein said particular one of said cycles is the one of the cycles executed earliest by the appliance.

6. The control of claim 1 including memory means for storing cycle counts obtained by said counting means and corresponding cycles of operation of said appliance, and processor means for identifying which one of said cycle counts is a maximum count, said selecting means including means for selecting a cycle corresponding to said maximum cycle count as said default cycle.

7. The control of claim 6, including means for storing a threshold count and means for limiting cycle counts to said threshold count.

8. The control of claim 6, including means for incrementing in said memory means the count of a cycle currently executed by the appliance, and, in response to the threshold count, decrementing in said memory means the counts of all cycles other than the cycle being executed.

9. In an appliance having user selectable cycles of operation, input means for receiving cycle selections made by the user and means responsive to said input means for controlling said appliance to execute a cycle currently selected by the user, a method of selecting a default cycle of operation of said appliance in an absence of a current user selected cycle, comprising the steps of:

monitoring the cycles executed by said appliance;

counting the number of times each cycle is executed by the appliance;

determining a maximum cycle count; and selecting the cycle corresponding to the maximum cycle count as the default cycle.

10. The method of claim 9, including the steps of detecting plural cycles corresponding to the same maximum count, developing a hierarchy of cycles and tie breaking by selecting in accordance with said hierarchy one of said cycles corresponding to said plural count as said default cycle.

11. The method of claim 9, including the steps of detecting plural cycles corresponding to the same maximum count, and tie breaking by selecting an earliest one of said plural cycles executed by the appliance as said default cycle.

12. The method of claim 9, including the steps of establishing a threshold count, and limiting the cycle count to said threshold count.

13. The method of claim 12, including establishing said threshold count as a function of a rate of change of cycles selected by the user.

14. The method of claim 12, wherein said counting step includes incrementing the count corresponding to each cycle as said cycle is executed by the appliance, and, when the cycle count is at least as great as the threshold count, decrementing the count corresponding to each cycle other than the cycle being executed.

15. A dishwasher, comprising:

means for controlling said dishwasher to operate in a user selected cycle;

input means for receiving user cycle selections; and default cycle selection means for selecting a cycle in an absence of a user selected cycle at said input means, said default cycle selection means including means responsive to said input means for counting the number of times each cycle is executed by the dishwasher, means for identifying a particular cycle having a count that has a first predetermined relationship to the counts of the other cycles, and means for selecting said particular cycle as the default cycle.

16. The dishwasher of claim 15, further including means for controlling said dishwasher to operate in user selected options associated with said user selected cycles, and wherein said default cycle selection means further includes means responsive to said input means for counting the number of times each option is executed by the dishwasher, and means for selecting a particular option having a count that has a second predetermined relationship to the counts of the other options as the default option.

17. The dishwasher of claim 16, wherein said second predetermined relationship is a maximum whereby the particular option selected as the default option has a maximum option count.

18. The dishwasher of claim 15, wherein said first predetermined relationship is a maximum whereby the particular cycle selected as the default cycle has a maximum cycle count.

19. The dishwasher of claim 17, wherein said default cycle selecting means includes means for detecting plural cycles having the maximum count, means for storing a cycle hierarchy, and tie breaking means for selecting one of said plural cycles in accordance with said cycle hierarchy as said default cycle.

20. The dishwasher of claim 15, wherein said default cycle selecting means further includes means for storing a threshold cycle count and means for limiting cycle counts to the magnitude of the threshold count.

21. The dishwasher of claim 20, wherein said default cycle selecting means further includes means for detecting a rate of change of cycles selected by the user and, in response, determining said threshold cycle count.

22. The dishwasher of claim 20, wherein said default cycle selecting means includes means for incrementing the count of each cycle executed by the dishwasher, means for detecting cycle count equal to the threshold count, and, in response, determining the count of all cycles other than the cycle being currently executed.

23. In a dishwasher operable in user selected cycles, input means for receiving user cycle selections and default means for controlling said dishwasher to operate in a default cycle in an absence of a user cycle selection at said input means, an improvement comprising means for monitoring user cycle selections made at said input means, means for counting the cycles previously executed, and means responsive to the cycle counts for selecting one of said previously executed cycles as the default cycle.

24. The improvement of claim 23, including means for displaying the default cycle.

* * * * *